US010262565B2

(12) United States Patent
Xiang et al.

(10) Patent No.: US 10,262,565 B2
(45) Date of Patent: Apr. 16, 2019

(54) ORGANIC LIGHT-EMITTING DISPLAY PANEL, METHOD AND APPARATUS FOR TESTING THE SAME, AND METHOD FOR DISPLAYING ON THE SAME

(71) Applicant: SHANGHAI TIANMA AM-OLED CO., LTD., Shanghai (CN)

(72) Inventors: Dongxu Xiang, Shanghai (CN); Yue Li, Shanghai (CN); Yana Gao, Shanghai (CN); Renyuan Zhu, Shanghai (CN); Zhonglan Cai, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/807,438

(22) Filed: Nov. 8, 2017

(65) Prior Publication Data

US 2018/0068602 A1 Mar. 8, 2018

(30) Foreign Application Priority Data

Jul. 4, 2017 (CN) ..... 2017 1 0538125

(51) Int. Cl.

| | |
|---|---|
| ***G09G 3/00*** | (2006.01) |
| ***G09G 3/20*** | (2006.01) |
| ***G09G 3/3258*** | (2016.01) |
| ***G09G 3/3208*** | (2016.01) |

(52) U.S. Cl.

CPC ..... *G09G 3/006* (2013.01); *G09G 3/2007* (2013.01); *G09G 3/3208* (2013.01); *G09G 3/3258* (2013.01); *G09G 2320/0257* (2013.01); *G09G 2320/0271* (2013.01); *G09G 2320/0276* (2013.01); *G09G 2320/0626* (2013.01)

(58) Field of Classification Search

CPC ..... G09G 3/006; G09G 3/3233; G09G 2300/0819; G09G 2320/0257; G09G 2330/12; G09G 3/3258; G09G 2320/0295; G09G 2320/043; G09G 2330/10; G09G 3/3208

See application file for complete search history.

(56) References Cited

U.S. PATENT DOCUMENTS

| | | | | |
|---|---|---|---|---|
| 9,355,596 | B2 | 5/2016 | Shin et al. | |
| 9,626,888 | B2 * | 4/2017 | Wang | G09G 3/006 |
| 9,881,555 | B2 * | 1/2018 | Park | G09G 3/3258 |
| 2016/0247429 | A1 * | 8/2016 | Li | H01L 51/0031 |

* cited by examiner

*Primary Examiner* — Koosha Sharifi-Tafreshi
(74) *Attorney, Agent, or Firm* — Alston & Bird LLP

(57) ABSTRACT

The invention discloses an organic light-emitting display panel, a method and apparatus for testing the same, and a method for displaying on the same. The luminance of each of grayscales of a displayed picture is preset; a data signal voltage corresponding to the highest grayscale is determined while switching from a preset picture to another picture without any afterimage. An active pulse duty cycle of a light-emission control signal is determined according to the determined data signal voltage and the luminance of the highest grayscale. Data signal voltages corresponding to the other grayscales are determined. The determined active pulse duty cycle of the light-emission control signal, and the determined data signal voltages corresponding to the respective grayscales are stored.

9 Claims, 6 Drawing Sheets

ORGANIC LIGHT-EMITTING DISPLAY PANEL, METHOD AND APPARATUS FOR TESTING THE SAME, AND METHOD FOR DISPLAYING ON THE SAME

CROSS-REFERENCES TO RELATED APPLICATIONS

This application claims priority to Chinese patent application No. CN201710538125.3 filed on Jul. 4, 2017 and titled "ORGANIC LIGHT-EMITTING DISPLAY, METHOD AND APPARATUS FOR TESTING THE SAME, AND METHOD FOR DISPLAYING ON THE SAME", which is incorporated herein by reference in its entirety.

FIELD

The present invention relates to the field of display technologies, and particularly to an organic light-emitting display panel, a method and apparatus for testing the same, and a method for displaying on the same.

BACKGROUND

Electroluminescent organic light-emitting diodes, a new generation of display devices have gained popular attention due to their self-luminescence, rapid response, wide angle of view, possible fabrication into a flexible display screen, and other unique characteristics. Organic Light-Emitting Diodes (OLEDs) which are current-driven active light-emitting display devices can be categorized into Passive Matrix-Organic Light-Emitting Diodes (PM-OLEDs) and Active Matrix-Organic Light-Emitting Diodes (AM-OLEDs), dependent upon their driver modes. Instantaneous high current required in a passive driver mode may come with high power consumption, low efficiency, and other drawbacks, and these drawbacks can be overcome with the AM-OLEDs which display a high resolution with low power consumption.

In the AM-OLEDs, organic light-emitting diodes are driven using thin film transistors, which are made of polysilicon at low temperature, to emit light. However a forward transfer characteristic and a reverse transfer characteristic of a thin film transistor (TFT) may have a hysteresis, so that the luminance presented on a pixel when switched from a dark state to a bright state may not be the same as the luminance presented on the pixel being switched from a bright state to a dark state at the same grayscale. The forward transfer characteristic and the reverse transfer characteristic may be significantly different from each other particularly in a range of mid-low grayscales, that is, when the pixel is switched from a dark state to some mid-low grayscale, or from a bright state to the same mid-low grayscale, then an afterimage of a preceding frame of image may appear in a switched picture despite the same data signal, input to the pixel, corresponding to the mid-low grayscale.

SUMMARY

Embodiments of the invention provide an organic light-emitting display panel, a method and apparatus for testing the same, and a method for displaying on the same so as to alleviate an afterimage from appearing on the display panel after an image is switched thereon.

In a first aspect, an embodiment of the invention provides a method for testing an organic light-emitting display panel, including:

presetting a highest grayscale luminance of a preset picture, and the other grayscale luminance of the preset picture on the organic light-emitting display panel;

determining a data signal voltage corresponding to the highest grayscale of the preset picture, under the condition that there is no afterimage while controlling the preset picture to be switched to another picture;

determining an active pulse duty cycle of a light-emission control signal according to the determined data signal voltage, and the highest grayscale luminance;

determining data signal voltages corresponding to the other grayscales according to the determined active pulse duty cycle and the preset other grayscale luminance; and storing the determined active pulse duty cycle of the light-emission control signal, and the determined data signal voltages at the highest grayscale and the other grayscales.

In an implementation, in the testing method above according to the embodiment of the invention, the determining the data signal voltage corresponding to the highest grayscale under the condition that there is no afterimage while controlling the preset picture to be switched to another picture includes:

controlling the preset picture to be switched to the another picture;

adjusting the data signal voltage corresponding to the highest grayscale of the preset picture until the preset picture is switched to the another picture without showing any after image; and determining the data signal voltage corresponding to the highest grayscale.

In an implementation, in the testing method above according to the embodiment of the invention, the adjusting the data signal voltage corresponding to the highest grayscale of the preset picture includes:

increasing gradually the data signal voltage corresponding to the highest grayscale of the preset picture.

In an implementation, in the testing method above according to the embodiment of the invention, the controlling the preset picture to be switched to another picture includes:

controlling the preset picture to be switched to another picture using a preset active pulse duty cycle of a light-emission control signal.

In an implementation, in the testing method above according to the embodiment of the invention, the determining the active pulse duty cycle of the light-emission control signal according to the determined data signal voltage, and the highest grayscale luminance includes:

lighting the organic light-emitting display panel using the determined data signal voltage, and decreasing gradually the active pulse duty cycle of the light-emission control signal to reach the preset highest grayscale luminance.

In an implementation, in the testing method above according to the embodiment of the invention, the active pulse duty cycle of the light-emission control signal ranges from 75% to 85% when the preset highest grayscale luminance ranging from 300 nit to 400 nit.

In an implementation, in the testing method above according to the embodiment of the invention, the active pulse duty cycle of the light-emission control signal is 80% when the preset highest grayscale luminance being 350 nit.

In an implementation, in the testing method above according to the embodiment of the invention, the determining the data signal voltages corresponding to the other grayscales according to the determined active pulse duty cycle, and the preset other grayscale luminance includes:

controlling the organic light-emitting display panel using the determined active pulse duty cycle of the light-emission control signal to display a picture including respective grayscales corresponding to initial data signal voltages; and increasing the data signal voltages corresponding to the respective grayscales so that the display luminance of the organic light-emitting display panel reaches the preset other grayscale luminance.

In a second aspect, an embodiment of the invention provides a method for displaying on an organic light-emitting display panel, including displaying using the active pulse duty cycle of the light-emission control signal, and the data signal voltages corresponding to the respective grayscales, stored in the testing method according to any one of the embodiments above of the invention.

In a third aspect, an embodiment of the invention provides an apparatus for testing an organic light-emitting display panel, including:

a first data signal determining unit configured to determine a data signal voltage corresponding to a highest grayscale while switching a preset picture including a highest grayscale luminance to another picture without showing any afterimage;

a light-emission control signal determining unit configured to determine an active pulse duty cycle of a light-emission control signal according to the determined data signal voltage, and the highest grayscale luminance;

a second data signal determining unit configured to determine data signal voltages corresponding to the other grayscales according to the determined active pulse duty cycle, and preset other preset grayscale luminance; and a storing unit configured to store the determined active pulse duty cycle of the light-emission control signal, and the determined data signal voltages corresponding to the respective grayscales.

In an implementation, in the testing apparatus above according to the embodiment of the invention, the first data signal determining unit is configured to control the preset picture to be switched to another picture; to adjust the data signal voltage corresponding to the highest grayscale of the preset picture until the preset picture is switched to another picture without showing any afterimage; and to determine the data signal voltage corresponding to the highest grayscale of the preset picture.

In an implementation, in the testing apparatus above according to the embodiment of the invention, the first data signal determining unit is configured to increase gradually the data signal voltage corresponding to the highest grayscale of the preset picture.

In an implementation, in the testing apparatus above according to the embodiment of the invention, the first data signal determining unit is configured to control the preset picture to be switched to another picture using a preset active pulse duty cycle of a light-emission control signal.

In an implementation, in the testing apparatus above according to the embodiment of the invention, the light-emission control signal determining unit is configured to light the organic light-emitting display panel using the determined data signal voltage, and to decrease the active pulse duty cycle of the light-emission control signal, so that the display luminance of the organic light-emitting display panel reaches the preset highest grayscale luminance.

In an implementation, in the testing apparatus above according to the embodiment of the invention, the active pulse duty cycle of the light-emission control signal ranges from 75% to 85% when the preset highest grayscale luminance ranging from 300 nit to 400 nit.

In an implementation, in the testing apparatus above according to the embodiment of the invention, the second data signal determining unit is configured to control the organic light-emitting display panel using the determined active pulse duty cycle of the light-emission control signal to display a picture including respective grayscales corresponding to initial data signal voltages; and to increase the data signal voltages corresponding to the respective grayscales so that the display luminance of the organic light-emitting display panel reaches the preset other grayscale luminance.

In a fourth aspect, an embodiment of the invention provides an organic light-emitting display panel including the apparatus above for testing an organic light-emitting display panel.

Advantageous effects of the invention are as follows.

In the organic light-emitting display panel, the method and apparatus for testing the same, and the method for displaying on the same according to the embodiments of the invention, the luminance of the highest grayscale and luminance of the other grayscales of a displayed picture on the organic light-emitting display panel are preset; a data signal voltage corresponding to the highest grayscale is determined while controlling the displayed picture on the organic light-emitting display panel to be switched from a preset picture including the luminance of the highest grayscale to another picture without showing any afterimage; an active pulse duty cycle of a light-emission control signal is determined according to the determined data signal voltage, and the luminance of the highest grayscale; data signal voltages corresponding to the other grayscales are determined according to the determined active pulse duty cycle, and the preset luminance of the other grayscales; and the determined active pulse duty cycle of the light-emission control signal, and the determined data signal voltages corresponding to the respective grayscales are stored. The data signal voltages are changed to alleviate an afterimage, and also the active pulse duty cycle of the light-emission control signal is adjusted to adjust a period of time for which the display panel emits light, so that the preset luminance at the respective grayscales can be reached.

DETAILED DESCRIPTION

In view of the problem of an afterimage on a display panel after an image is switched thereon in the prior art, embodiments of the invention provide an organic light-emitting display panel, a method and apparatus for testing the same, and a method for displaying on the same.

In order to make the objects, features, and advantages above of the invention more apparent and readily understood, the invention will be described below in further details with reference to the drawings and the embodiments thereof. However the exemplary embodiments can be put into practice in a number of forms, but shall not be limited thereto; and on the contrary, these embodiments are provided so that the invention become more comprehensive and complete, and the idea of the exemplary embodiments can be fully conveyed to those skilled in the art.

It shall be noted that particular details will be set forth in the following description to facilitate full understanding of the invention. However the invention can be embodied in a number of other implementations than those described here, and those skilled in the art can extend the exemplary embodiments without departing the scope of the invention. Accordingly the invention will not be limited to the particular embodiments to be disclosed below.

An organic light-emitting display panel, a method and apparatus for testing the same, and a method for displaying on the same according to the embodiments of the invention will be described below in details with reference to the drawings.

Figure 1:
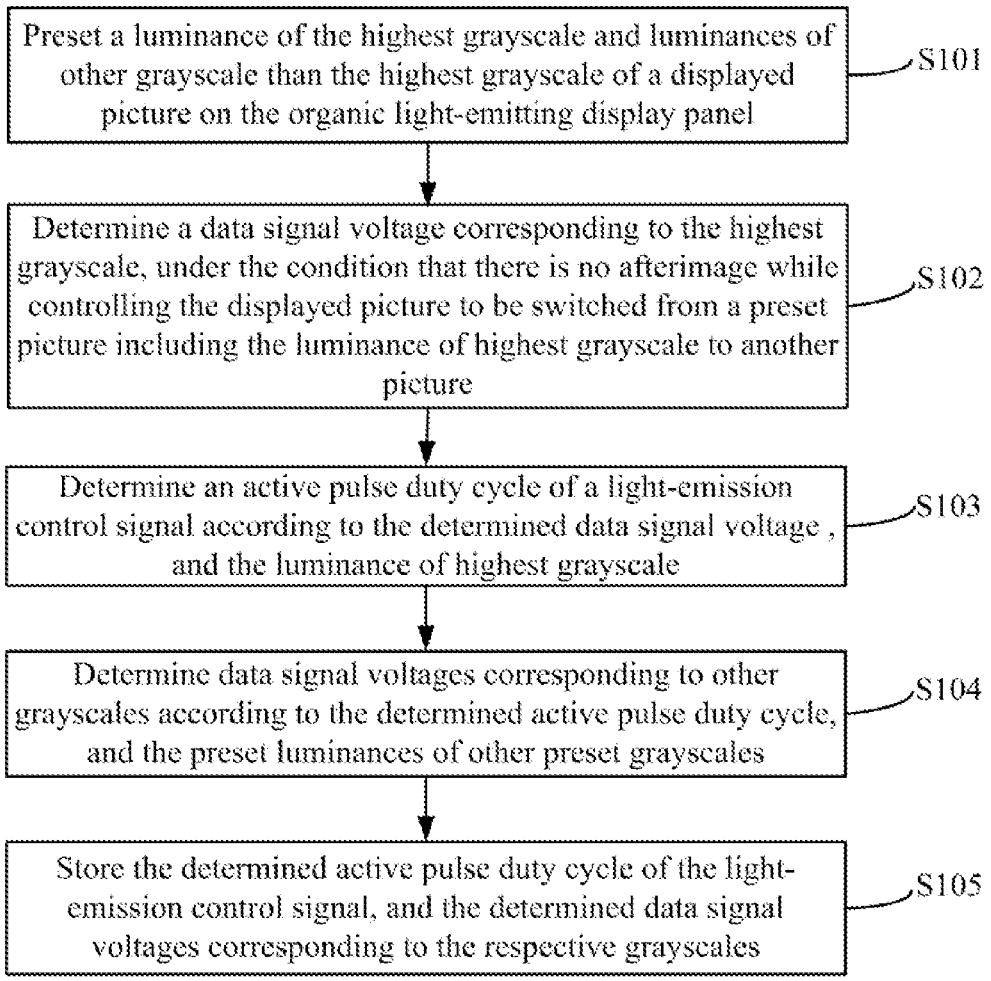
FIG. 1 is a first flow chart of a method for testing an organic light-emitting display panel according to an embodiment of the invention.

As illustrated in FIG. 1, an embodiment of the invention provides a method for testing an organic light-emitting display panel, where the method can particularly include the following steps.

The step S101 is to preset the luminance of the highest grayscale, and the luminance of other grayscales than the highest grayscale of a displayed picture on the organic light-emitting display panel.

The step S102 is to determine a current data signal voltage corresponding to the highest grayscale, on the condition that there is no afterimage while controlling the displayed picture on the organic light-emitting display panel to be switched from a preset picture including the luminance of the highest grayscale to another picture.

The step S103 is to determine an active pulse duty cycle of a light-emission control signal according to the determined data signal voltage, and the luminance of the highest grayscale.

The step S104 is to determine data signal voltages corresponding to the other grayscales according to the determined active pulse duty cycle, and the preset luminance of the other grayscale.

The step S105 is to store the determined active pulse duty cycle of the light-emission control signal, and the determined data signal voltages corresponding to the respective grayscales.

It shall be noted that the method above for testing an organic light-emitting display panel according to the embodiment of the invention is performed in a dimming mode of the organic light-emitting display panel. In the dimming mode, a period of time for which the display panel emits light can be changed for the purpose of changing overall luminance on the display panel, and in this solution in connection with the principle of adjusting the luminance in the dimming mode, the data signal voltages are changed to alleviate an afterimage from being displayed, and also the active pulse duty cycle of the light-emission control signal is adjusted to adjust the period of time for which the display panel emits light for the purpose of varying the luminance, so that even if the data signal voltages are not equal to their original voltages, then the display panel may display at the luminance corresponding to the original data signal voltages.

Particularly the luminance corresponding to the respective grayscales needs to be preset for the display panel before it is shipped from a factory, and typically the data signal voltages can be adjusted to adjust potentials input to gates of Thin Film Transistors (TFTs) driving organic light-emitting diodes to thereby change the voltage of the gates of the TFTs relative to the sources thereof so as to control the magnitudes of current flowing through the organic light-emitting diodes to change the intensity of light emitted by the light-emitting diodes. Accordingly after the luminance to be attained at the respective grayscales are determined, each grayscale corresponds to one of the data signal voltages, and in the embodiments of the invention, the data signal voltages will be referred to as original data signal voltages corresponding to the respective grayscales.

Figure 2A:
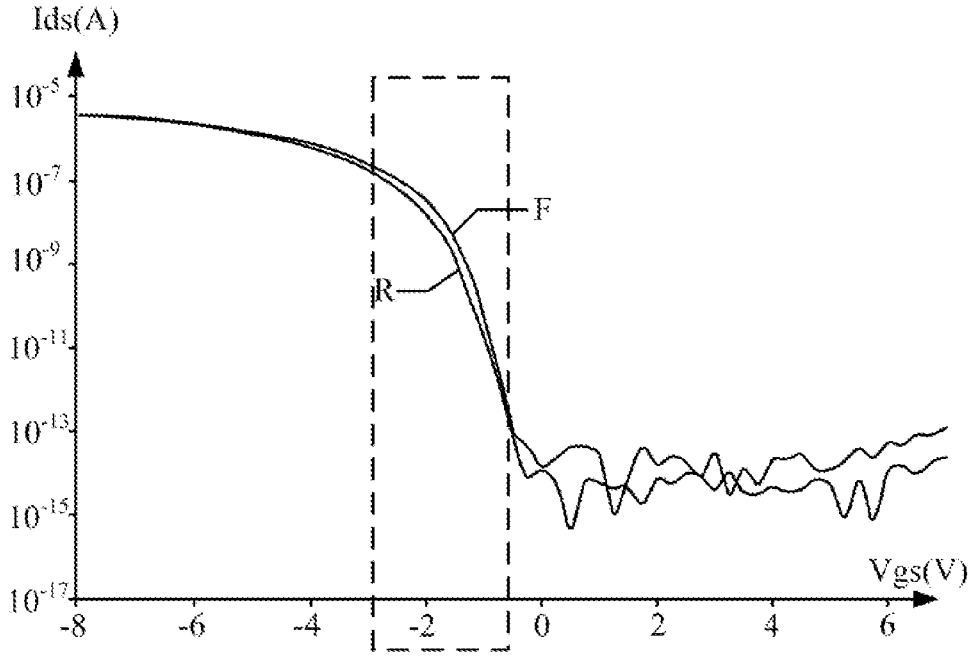
FIG. 2A is a chart comparing forward and reverse transfer characteristics of a TFT according to an embodiment of the invention.

In a real application, as illustrated in FIG. 2A, a forward scan characteristic curve F and a reverse scan characteristic curve R of a TFT driving an organic light-emitting diode to emit light may not overlap exactly with each other, where the dotted box in FIG. 2A represents a transfer characteristic curve of the TFT at mid-low grayscales, and when the voltage Vgs of the gate of the TFT relative to the source thereof is more than a voltage corresponding to the right edge of the dotted box, then Vgs will be less than threshold voltage, and the TFT will be turned off; and when the value of the voltage Vgs of the gate of the TFT relative to the source thereof falls into the dotted box, or less than respective voltages corresponding to the dotted box or the left edge thereof, then current flowing through the TFT may drive the organic light-emitting diode to emit light. At this time, the data signal voltage is changed to vary Vgs to thereby vary the light-emission current driving the organic light-emitting diode to emit light so as to change the luminance of the organic light-emitting diode accordingly to display at the respective grayscales.

Figure 2B:
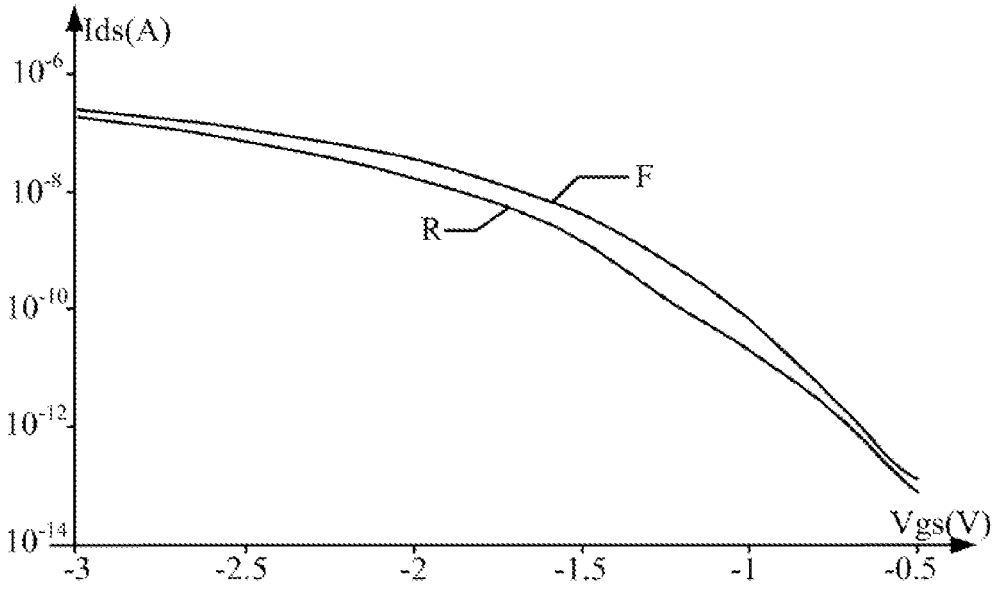
FIG. 2B is a first chart comparing improved forward and reverse transfer characteristics of the TFT according to an embodiment of the invention.

Furthermore FIG. 2B is a diagram showing an improved forward and reverse transfer characteristic curve in the dotted box in FIG. 2A, where the part corresponds to the transfer characteristic curve of the TFT in a range of mid-low grayscales of the organic light-emitting diode. As can be apparent from FIG. 2B, the forward scan transfer characteristic curve F and the reverse scan transfer characteristic curve R of the TFT are the most significantly different from each other in the range of low grayscales, so when the organic light-emitting diode is switched from a dark state to some low grayscale, and from a bright state to some low grayscale, then a voltage of a data signal will be switched to the original data signal voltage corresponding to the low grayscale. However since the forward scan transfer characteristic curve F and the reverse scan transfer characteristic curve R of the TFT are significantly different from each other in the range of low grayscales, different light-emission current Ids may be produced even if the same original data signal voltage is input in both of the switching states, so the organic light-emitting diode will display at different luminance, thus resulting in an afterimage to be displayed while a picture is being switched.

As can be observed from the forward scan transfer characteristic curve F and the reverse scan transfer characteristic curve R as illustrated in FIG. 2A, the difference between two transfer characteristic curves will become smaller as the value of Vgs becomes larger reversely, and when the difference in Ids lies in an acceptable range, then the two transfer characteristic curves may substantially coincide with each other, so when Vgs corresponding to the respective grayscales of the organic light-emitting diode to be displayed is set in this range, then no afterimage will appear.

The testing method above according to the embodiment of the invention has been proposed from the perspective of the idea above, where firstly the luminance of respective grayscales of a displayed picture on the organic light-emitting display panel is preset, and the luminance of respective grayscales can be preset according to the luminance corresponding to the respective grayscales as required for the display panel to be shipped.

Figure 3:
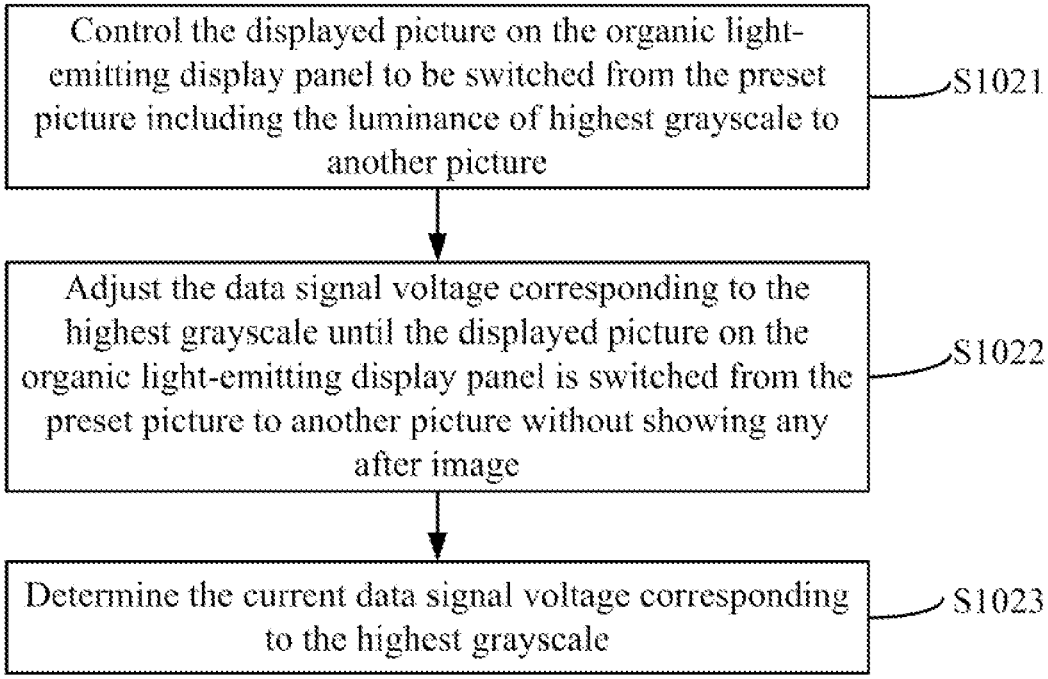
FIG. 3 is a second flow chart of a method for testing an organic light-emitting display panel according to an embodiment of the invention.

Furthermore as illustrated in FIG. 3, in the step S102 above, the data signal voltage corresponding to the highest grayscale can be determined under the condition that there is no afterimage while controlling the displayed picture on the organic light-emitting display panel to be switched from the preset picture to another picture particularly in the following sub-steps.

The sub-step S1021 is to control the displayed picture on the organic light-emitting display panel to be switched from the preset picture including the luminance of the highest grayscale to another picture.

The sub-step S1022 is to adjust the data signal voltage corresponding to the highest grayscale until the displayed picture on the organic light-emitting display panel is switched from the preset picture to another picture without any after image.

The sub-step S1023 is to determine the current data signal voltage corresponding to the highest grayscale.

Figure 4A:
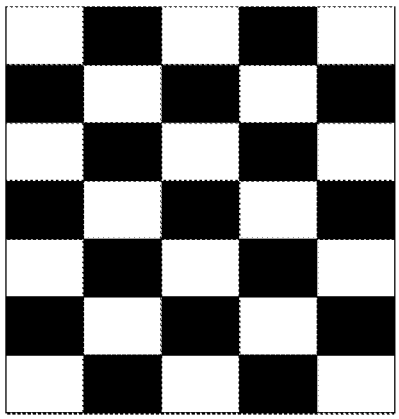
FIG. 4A is a schematic diagram of a preset target picture including the luminance of the highest grayscale according to an embodiment of the invention.

In a real application, the preset picture including the luminance of the highest grayscale may be a tessellated picture as illustrated in FIG. 4A consisted of the luminance of the highest grayscale and the luminance of the lowest grayscale. In FIG. 4A, the white color represents a zone with the luminance of highest grayscale in the picture, and the black color represents a zone with the luminance of lowest grayscale in the picture. Hereupon the tessellated picture may be switched to a picture including the luminance of any other grayscale than the luminance of the highest grayscale, and when there is an afterimage of the original tessellated picture in the switched picture, then after the data signal voltage corresponding to the highest grayscale is adjusted, then the displayed picture may be switched back to the tessellated picture, and the tessellated picture may be switched again to a picture including the luminance of any other grayscale than the luminance of the highest grayscale. If there is still an afterimage of the tessellated picture in the switched picture, then the data signal voltage corresponding to the highest grayscale may be adjusted again until there is no afterimage of the tessellated picture in the switched picture, and at this time, the data signal voltage corresponding to the highest grayscale may be recorded.

Figure 4B:
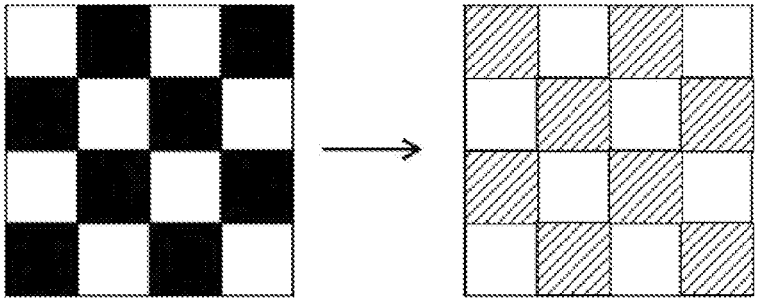
FIG. 4B is a schematic diagram of switching of a preset picture including the luminance of the highest grayscale when there is afterimage in the switched picture according to an embodiment of the invention.
Figure 4C:
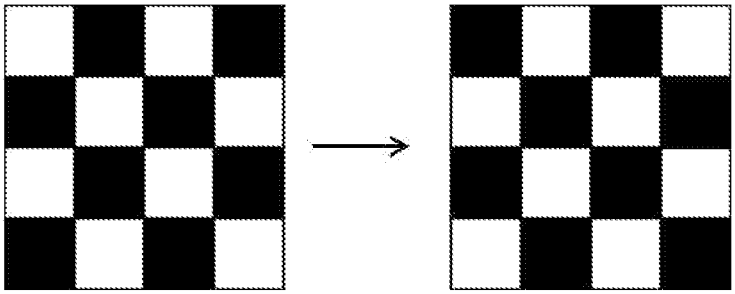
FIG. 4C is a schematic diagram of switching of a preset picture including the luminance of the highest grayscale when there is no afterimage in the switched picture according to an embodiment of the invention.

For example. FIGS. 4B and 4C show the switching of the preset picture including the luminance of the highest grayscale, in FIG. 4B, there is an afterimage in the switched picture, while in FIG. 4C, there is no afterimage in the switched picture. In FIG. 4B, the padding portion represents gray color, and when the white color i.e., the luminance of the highest grayscale, is switched to a black color, there is an afterimage in the switched picture. In FIG. 4C, when the white color is switched to a black color, there is no afterimage in the switched picture.

Furthermore in the step S1021 above, the displayed picture on the organic light-emitting display panel can be controlled from the preset picture to another picture particularly as follows.

The displayed picture on the organic light-emitting display panel is controlled from the preset picture to another picture using a preset active pulse duty cycle of a light-emission control signal.

Hereupon in the step S1022 above, the data signal voltage corresponding to the highest grayscale can be adjusted particularly as follows.

The data signal voltage corresponding to the highest grayscale is increased gradually.

In a real application, a Thin Film Transistor (TFT) controlling an organic light-emitting diode to emit light is turned on and off by a light-emission control signal input to a gate thereof, and only when the TFT is turned on, then the organic light-emitting diode may emit light, where the length of time for which the organic light-emitting diode emits light is determined by the length of time for which the TFT is turned on, and the length of time for which the organic light-emitting diode emits light is larger, then the luminance of a picture will be higher. Accordingly the display luminance of the display panel can be controlled by controlling an active pulse duty cycle of the light-emission control signal, where an active pulse of the light-emission control signal is configured to control the organic light-emitting display panel to emit light, and the active pulse duty cycle is larger, then the display luminance of the organic light-emitting display panel will be higher. In the testing method above according to the embodiment of the invention, the active pulse duty cycle of the light-emission control signal can be preset to a preset value, and the picture can be switched by driving the organic light-emitting display panel using the preset active pulse duty cycle to emit light and display.

Furthermore in the embodiment of the invention, the data signal voltage corresponding to the highest grayscale is increased gradually, and it shall be noted in the embodiment of the invention, the data signal voltage being increased gradually refers to the data signal voltage being adjusted so that the corresponding organic light-emitting diode reaches the higher luminance. In connection with the description of the idea above where the data signal voltage corresponding to the highest grayscale is adjusted by increasing the light-emission current Ids of the organic light-emitting diode, it is typical in a pixel circuit driven by an N-type TFT that if there is a larger data signal voltage, then the voltage Vgs of the gate of the driver transistor relative to the source thereof will be higher, driving current of the pixel (i.e., Ids) will be higher, and the luminance of the pixel will be higher. In a pixel circuit driven by a P-type TFT that if there is a smaller data signal voltage, or a larger absolute value thereof, then the voltage Vgs of the gate of the driver transistor relative to the source thereof will be higher, driving current of the pixel (i.e., Ids) will be higher, and the luminance of the pixel will be higher. Accordingly in the invention, the data signal voltage being increased gradually refers to the absolute value of the data signal voltage being increased. FIG. 2A and FIG. 2B illustrate the principle of the transfer characteristics followed by the testing method above according to the embodiment of the invention, where when the voltage Vgs of the gate of the driver transistor relative to the source thereof is increased reversely, then the difference between the two transfer characteristic curves may become smaller, and at the same time, the driving current Ids of the organic light-emitting diode may also increase therewith.

As can be appreciated, after the driving current is adjusted up, the display luminance of the driven organic light-emitting diode at the highest grayscale is increased so that the display luminance may exceed the originally preset luminance of highest grayscale. In view of this, in order for the luminance to satisfy the originally preset luminance of highest grayscale, in the step S103 above, the active pulse duty cycle of the light-emission control signal can be determined according to the determined data signal voltage, and the luminance of highest grayscale particularly as follows.

The organic light-emitting display panel is lightened using the determined data signal voltages, and the active pulse duty cycle of the light-emission control signal is decreased gradually, so that the display luminance of the organic light-emitting display panel reaches the preset luminance of the highest grayscale.

As described, if the active pulse duty cycle of the light-emission control signal has been preset to the preset value while the picture is being switched, then the active pulse duty cycle of the light-emission control signal may be decreased from the preset value to thereby shorten a period of time for which the organic light-emitting display panel displays, for the purpose of lowering the luminance. In a particular application, the active pulse duty cycle of the light-emission control signal as a result of the adjustment may vary with the varying preset luminance of highest grayscale, preset active pulse duty cycle of the light-emission control signal, and luminance of the display panel after the data signal voltage is increased. For example, when the data signal voltage at the highest grayscale is increased by more than an increase of the original data signal voltage, then the decreased active pulse duty cycle of the light-emission control signal will be smaller; and when the data signal voltage at the highest grayscale is increased by less than an increase of the original data signal voltage, then the decreased active pulse duty cycle of the light-emission control signal will be larger.

Figure 5:
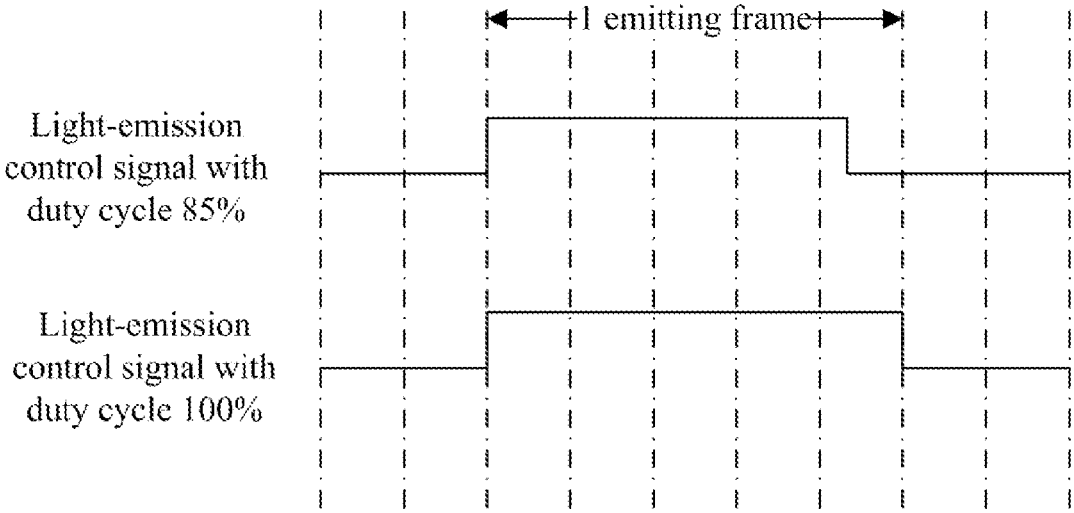
FIG. 5 is a timing diagram of the light-emission control signal in the dimming mode according to an embodiment of the invention.

In the embodiment of the invention, test experiments were made using a number of values for the adjustment, and as experiment results showed, the active pulse duty cycle of the light-emission control signal as a result of the adjustment ranges from 75% to 85% at the preset highest grayscale luminance of 300 nit to 400 nit. FIG. 5 illustrates the timing diagram of the light-emission control signal with duty cycle 85% and duty cycle 100% in the dimming mode. For example, one Frame includes emitting frame, and the initial emitting time length of the emitting frame is preset as 100%, and with the solution of the invention, the emitting time length of the emitting frame is adjusted, and the ratio of the adjusted emitting time length and the initial emitting length, for example, is 85% (that is the duty cycle 85%) as illustrated in FIG. 5. By way of an example, in the test experiments, when the preset highest grayscale luminance is 350 nit, then the adjusted active pulse duty cycle of the light-emission control signal may drop by a factor of 80%. As described above, the active pulse duty cycle of the light-emission control signal is adjusted dependent upon both the lastly adjusted data signal voltage at the highest grayscale, and the preset reference value for the active pulse duty cycle of the light-emission control signal, so in the embodiment of the invention, the experiments were made only on the testing method above according to the embodiment of the invention, but the particular luminance value at the highest grayscale, and the particular value of the adjusted active pulse duty cycle of the light-emission control signal will not be limited thereto as long as the relationship between the values in question derived in the method according to the embodiment of the invention falls into the scope of the invention as claimed.

Figure 6:
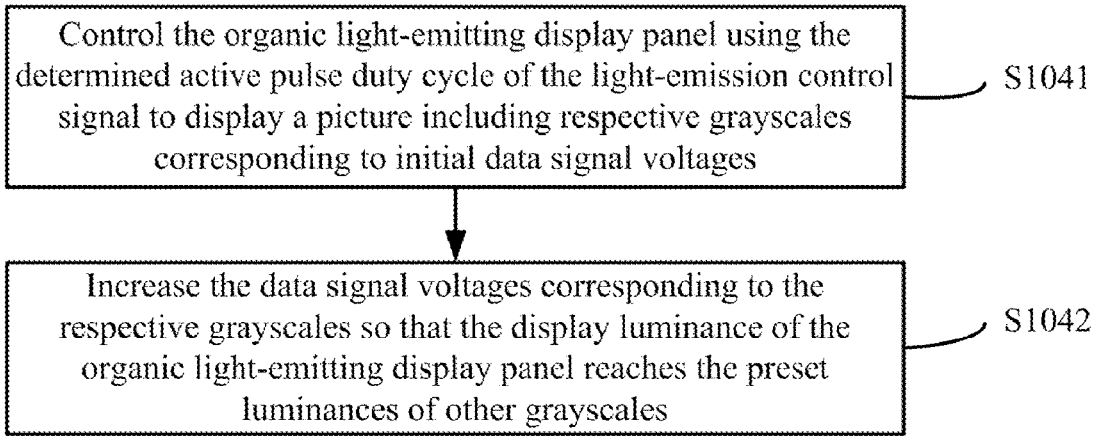
FIG. 6 is a third flow chart of a method for testing an organic light-emitting display panel according to an embodiment of the invention.

Furthermore as illustrated in FIG. 6, in the step S104 above, the data signal voltages corresponding to the respective other grayscales can be determined according to the determined active pulse duty cycle, and the preset luminance of the other grayscales particularly in the following sub-steps.

The sub-step S1041 is to control the organic light-emitting display panel using the determined active pulse duty cycle of the light-emission control signal to display a picture including respective grayscales corresponding to initial data signal voltages.

The sub-step S1042 is to increase the data signal voltages corresponding to the respective grayscales so that the display luminance of the organic light-emitting display panel reaches the preset luminance of the other grayscales.

In order to alleviate an afterimage from being displayed, the data signal voltage corresponding to the highest grayscale is increased from the original data signal voltage, and the active pulse duty cycle of the light-emission control signal is further adjusted according to the data signal voltage, so the data signal voltages corresponding to the other grayscales than the highest grayscale also need to be adjusted at the same active pulse duty cycle of the light-emission control signal to thereby enable the resulting display luminance of the respective grayscales to reach the preset luminance of respective grayscales. In a real application, the data signal voltage corresponding to the highest grayscale is relatively increased, so the data signal voltages corresponding to the other grayscales (than the lowest grayscale) also need to be relatively increased to thereby reach their preset luminance. In the embodiment of the invention, the data signal voltage of a grayscale being increased also refers to the absolute value of the data signal voltage being increased.

Figure 7:
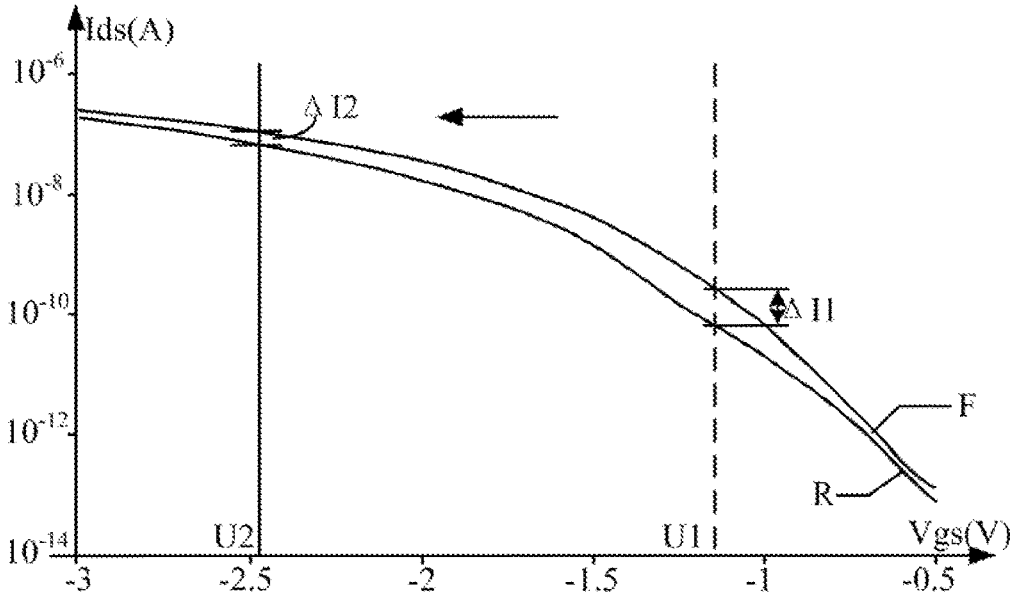
FIG. 7 is a second diagram comparing improved forward and reverse transfer characteristics of the TFT according to an embodiment of the invention.

After the data signal voltages of the respective grayscales, and the active pulse duty cycle of the light-emission control signal are adjusted in the testing method above according to the embodiment of the invention, no afterimage will appear while the displayed image is being switched. As illustrated in FIG. 7, before the data signal voltages are adjusted as described above, the voltage of the gate of a drive transistor corresponding to an original data signal voltage of some low grayscale relative to the source thereof is U1, and when the displayed picture is switched from a bright state (corresponding to the highest grayscale) to a picture at the low-grayscale, or when the displayed picture is switched from a dark state (corresponding to the lowest grayscale) to the picture at the low-grayscale, then there will be such a difference in driving current ΔI1 that goes beyond a human-eye recognizable range, so there will be an afterimage to be displayed while watching the picture being switched. After the adjustment above is made, the voltage of the gate of the driver transistor corresponding to the adjusted data signal voltage relative to the source thereof is U2, and as can be apparent from FIG. 7, there is such a difference in driving current ΔI2 at U2 that is so insignificant that the human eyes watching the picture switched from a bright state or a dark state to the picture at the low grayscale watches the displayed picture at the same luminance due to the insignificant difference in driving current ΔI2, that is, the displayed afterimage has been alleviated while the picture is being switched.

Further to the method above for testing an organic light-emitting display panel, an embodiment of the invention further provides a method for displaying on an organic light-emitting display panel, where the method includes displaying using the stored active pulse duty cycle of the light-emission control signal, and data signal voltages corresponding to the respective grayscales. With the data signal voltages of the respective grayscales determined in the testing method above, the range of the voltage on the gates of their corresponding driver transistors relative to the sources thereof lies in the range where there is an insignificant difference between the forward scan transfer characteristic curve and the reverse scan transfer characteristic curve, so there will be no afterimage while the picture is being displayed.

Based upon the inventive idea, an embodiment of the invention further provides an apparatus for testing an organic light-emitting display panel. Since the apparatus addresses the problem under a similar principle to the method above for testing an organic light-emitting display panel according to the embodiment of the invention, reference can be made to the implementation of the method for an implementation of the apparatus, so a repeated description thereof will be omitted here.

Figure 8:
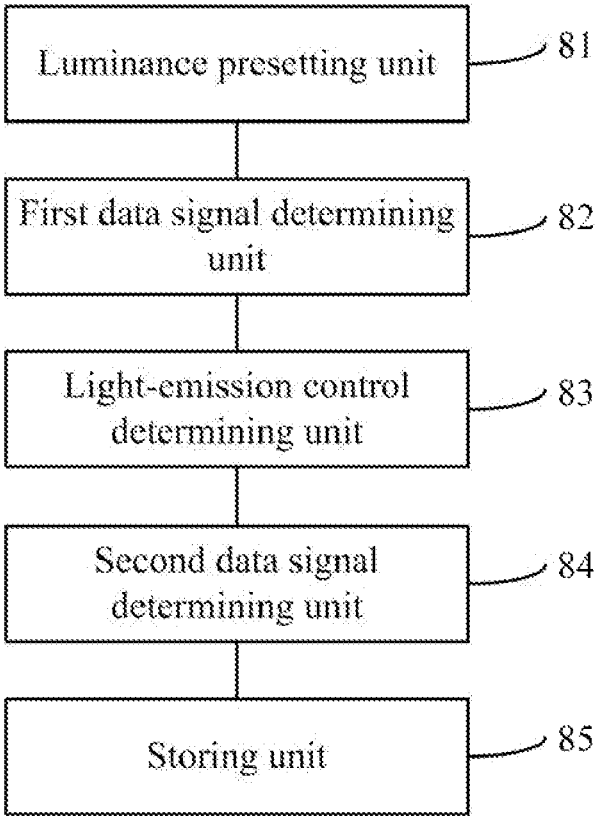
FIG. 8 is a schematic structural diagram of an apparatus for testing an organic light-emitting display panel according to an embodiment of the invention.

As illustrated in FIG. 8, an apparatus for testing an organic light-emitting display panel according to an embodiment of the invention includes the following units.

A luminance presetting unit 81 is configured to preset a luminance of a highest grayscale, and luminance of other grayscales than the highest grayscale of a displayed picture on the organic light-emitting display panel.

A first data signal determining unit 82 is configured to determine a data signal voltage corresponding to the highest grayscale, under the condition that there is no afterimage while controlling the displayed picture on the organic light-emitting display panel from a preset picture including the luminance of the highest grayscale to another picture.

A light-emission control signal determining unit 83 is configured to determine an active pulse duty cycle of a light-emission control signal according to the determined data signal voltage, and the luminance of the highest grayscale.

A second data signal determining unit 84 is configured to determine data signal voltages corresponding to the other grayscales according to the determined active pulse duty cycle, and the preset luminance of the other grayscales.

A storing unit 85 is configured to store the determined active pulse duty cycle of the light-emission control signal, and the determined data signal voltages corresponding to the respective grayscales.

Optionally the first data signal determining unit 82 is configured to control the displayed picture of the organic light-emitting display panel to be switched from the preset picture including the luminance of the highest grayscale to another picture; to adjust the data signal voltage corresponding to the highest grayscale until the displayed picture on the organic light-emitting display panel is switched from the preset picture to another picture without any afterimage; and to determine the current data signal voltage corresponding to the highest grayscale.

Optionally the first data signal determining unit 82 is configured to increase gradually the data signal voltage corresponding to the highest grayscale.

Optionally the first data signal determining unit 82 is configured to control the displayed picture of the organic light-emitting display panel to be switched from the preset picture to the another picture using a preset active pulse duty cycle of a light-emission control signal.

Optionally the light-emission control signal determining unit 83 is configured to lighten the organic light-emitting display panel using the determined data signal voltage, and to decrease the active pulse duty cycle of the light-emission control signal, so that the display luminance of the organic light-emitting display panel reaches the preset luminance of the highest grayscale.

Optionally the active pulse duty cycle of the light-emission control signal ranges from 75% to 85% when the preset luminance of the highest grayscale ranging from 300 nit to 400 nit.

Optionally the second data signal determining unit 84 is configured to control the organic light-emitting display panel using the determined active pulse duty cycle of the light-emission control signal to display a picture including respective grayscales corresponding to initial data signal voltages; and to increase the data signal voltages corresponding to the respective grayscales so that the display luminance of the organic light-emitting display panel reaches the preset luminance of the other grayscales.

Moreover an embodiment of the invention further provides an organic light-emitting display panel including the testing apparatus according to any one of the embodiments above, where the organic light-emitting display panel determines the active pulse duty cycle of the light-emission control signal, and the data signal voltages corresponding to the respective grayscales using the testing apparatus, so that there will be no afterimage while the image is being switched, thus improving an experience of viewing the image.

In the organic light-emitting display panel, the method and apparatus for testing the same, and the method for displaying on the same according to the embodiments of the invention, the luminance of the highest grayscale, and luminance of other grayscales than the highest grayscale of a displayed picture on the organic light-emitting display panel are preset; a data signal voltage corresponding to the highest grayscale is determined while controlling the displayed picture on the organic light-emitting display panel to be switched from a preset picture including the luminance of the highest grayscale to another picture without any afterimage; an active pulse duty cycle of a light-emission control signal is determined according to the determined data signal voltage, and luminance of the highest grayscale; data signal voltages corresponding to other grayscales are determined according to the determined active pulse duty cycle, and the luminance of the other grayscales; and the determined active pulse duty cycle of the light-emission control signal, and the determined data signal voltages corresponding to the respective grayscales are stored. The data signal voltages are changed to alleviate an afterimage, and also the active pulse duty cycle of the light-emission control signal is adjusted to adjust a period of time for which the display panel emits light, so that the preset luminance at the respective grayscales can be reached.

Although the preferred embodiments of the invention have been described, those skilled in the art benefiting from the underlying inventive concept can make additional modifications and variations to these embodiments. Therefore the appended claims are intended to be construed as encompassing the preferred embodiments and all the modifications and variations coming into the scope of the invention.

Evidently those skilled in the art can make various modifications and variations to the invention without departing from the spirit and scope of the invention. Thus the invention is also intended to encompass these modifications and variations thereto so long as the modifications and variations come into the scope of the claims appended to the invention and their equivalents.

What is claimed is:

1. A method for testing an organic light-emitting display panel, comprising:

presetting a highest grayscale luminance of a preset picture, and another grayscale luminance of the preset picture on the organic light-emitting display panel;

determining a data signal voltage corresponding to the highest grayscale of the preset picture, under a condition that there is no afterimage while controlling the preset picture to be switched to another picture;

determining an active pulse duty ratio of a light-emission control signal according to the determined data signal voltage, and the highest grayscale luminance;

determining data signal voltages corresponding to other grayscales according to the other grayscale luminance and the determined active pulse duty cycle; and storing the determined active pulse duty cycle and the data signal voltages at the highest grayscale and the other grayscales;

wherein the active pulse of the light-emission control signal is configured to control the organic light-emitting display panel to emit light.

2. The method according to claim 1, wherein determining the data signal voltage corresponding to the highest grayscale of the preset picture, under the condition that there is no afterimage while controlling the preset picture to be switched to another picture comprises:

controlling the preset picture to be switched to another picture;

adjusting the data signal voltage corresponding to the highest grayscale of the preset picture until the preset picture is switched to another picture without showing any afterimage; and determining the data signal voltage corresponding to the highest grayscale of the preset picture.

3. The method according to claim 2, wherein adjusting the data signal voltage corresponding to the highest grayscale of the preset picture comprises:

increasing gradually the data signal voltage corresponding to the highest grayscale of the preset picture.

4. The method according to claim 2, wherein controlling the preset picture to be switched to another picture comprises:

controlling the preset picture to be switched to another picture using a preset active pulse duty cycle of a light-emission control signal.

5. The method according to claim 1, wherein determining the active pulse duty cycle of the light-emission control signal according to the determined data signal voltage, and the highest grayscale luminance comprises:

lighting the organic light-emitting display panel using the determined data signal voltage, and decreasing gradually the active pulse duty ratio of the light-emission control signal to reach the preset highest grayscale luminance.

6. The method according to claim 5, wherein the active pulse duty cycle of the light-emission control signal ranges from 75% to 85% when the preset highest grayscale luminance ranging from 300 nit to 400 nit.

7. The method according to claim 6, wherein the active pulse duty cycle of the light-emission control signal is 80% when the preset highest grayscale luminance is 350 nit.

8. The method according to claim 5, wherein the determining the data signal voltages corresponding to the other grayscales according to the determined active pulse duty cycle, and the preset other grayscale luminance comprises:

controlling the organic light-emitting display panel using the determined active pulse duty cycle of the light-emission control signal to display a picture comprising respective grayscales corresponding to initial data signal voltages; and increasing the data signal voltages corresponding to the respective grayscales so that the display luminance of the organic light-emitting display panel reaches the preset other grayscale luminance.

9. A method for displaying on an organic light-emitting display panel, comprising displaying using the active pulse duty cycle of the light-emission control signal, and the data signal voltages corresponding to the respective grayscales, stored in the testing method according to claim 1.

* * * * *